US006634038B2

(12) United States Patent
Hsia

(10) Patent No.: US 6,634,038 B2
(45) Date of Patent: Oct. 21, 2003

(54) COLLAPSIBLE PLAYPEN WITH DETACHABLE COT

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 24 days.

(21) Appl. No.: 09/976,819

(22) Filed: Oct. 12, 2001

(65) Prior Publication Data

US 2003/0070229 A1 Apr. 17, 2003

(51) Int. Cl.[7] ..... A47D 7/00
(52) U.S. Cl. ..... 5/95; 5/93.1; 5/99.1; 5/93.2
(58) Field of Search ..... 5/93.1, 93.2, 98.1, 5/95, 97, 99.1

(56) References Cited

U.S. PATENT DOCUMENTS 6,058,528 A * 5/2000 Yang ..... 5/93.1
6,418,575 B1 * 7/2002 Cheng ..... 5/93.1

* cited by examiner

*Primary Examiner*—Teri Pham Luu
*Assistant Examiner*—Fredrick Conley
(74) *Attorney, Agent, or Firm*—Raymond Y. Chan; David and Raymond Patent Group

(57) ABSTRACT

A collapsible playpen includes a top frame to support a boundary shelter, a bottom frame, and a boundary shelter supported by the top frame to surround the interior space and define a playpen cavity therein. A detachable cot includes a surrounding wall and a bottom wall to define a supporting cavity therebetween, wherein the surrounding wall has an upper side holder for fittedly mounting on the top frame of the playpen, and a fastening device including a plurality of first fastener units provided on the side holder of the surrounding wall and a plurality of second fastener units provided on the boundary shelter for detachably fastening with the first fastener units respectively, so as to securely mount the detachable cot on the collapsible playpen.

7 Claims, 6 Drawing Sheets

COLLAPSIBLE PLAYPEN WITH DETACHABLE COT

BACKGROUND OF THE PRESENT INVENTION

1. Field of Invention

The present invention relates to a playpen, and more particularly to a collapsible playpen with detachable cot, which is capable of accommodating a baby or young child therein while being cost effective.

2. Description of Related Arts

Playpen is used to restrict the movement of a baby or a young child who is able to trail or walk when the parents cannot always keep their eyes on their babies. A conventional playpen comprises four vertical posts to support a cloth boundary that a baby or a young child can dispose therein. In order to restrict the movement of the baby within the area, the vertical posts must be high enough that the baby cannot climb out of the playpen. However, it is a hassle for the parent to pull and take a small child in the playpen.

Besides, for accommodating the baby comfortly, the parent usually pulls his or her baby on the cot. Therefore, the parent may merely purchase the playpen and cot individually to fit the need of the baby. However, it is unreasonable for the parent to buy all the baby's accessories at once, which is not only waste the money but also a waste of the luxury space.

SUMMARY OF THE PRESENT INVENTION

A main object of the present invention is to provide a collapsible playpen with detachable cot, which is capable of accommodating a baby or a young child therein.

Another object of the present invention is to provide a collapsible playpen with detachable cot, wherein the cot can be securely mounted on the playpen for substantially support a baby accommodated therein.

Another object of the present invention is to provide a collapsible playpen with detachable cot, wherein the cot is selectively mounted on an upper portion of the playpen to form a bed or disposed in the playpen for restricting the movement of the bag.

Another object of the present invention is to provide a collapsible playpen with detachable cot, wherein the cot is adapted to incorporate with a playpen without altering the original structural design of the playpen, so as to minimize the manufacturing cost of the playpen incorporating with the cot.

Another object of the present invention is to provide a collapsible playpen with detachable cot, wherein the attachment between the cot and the playpen is easy and fast, that is simply by tightly fastening the upper edge of the cot on the opening edge of the playpen.

Another object of the present invention is to provide a collapsible playpen with detachable cot, wherein no expensive or complicate structure is required to employ in the present invention in order to achieve the above mentioned objects. Therefore, the present invention successfully provides an economic and efficient solution for selectively using as a cot or a playpen.

Accordingly, in order to accomplish the above objects, the present invention provides a collapsible playpen, comprising:

a bottom frame having a supporting surface;

a top frame having four corners and defining a top opening therebetween;

a boundary frame which supports the top frame on top of the bottom frame and defining an interior space between the top frame and the bottom frame;

a boundary shelter supported by the top frame to surround the interior space and define a playpen cavity within the boundary shelter, the top frame and the bottom frame; and a detachable cot comprising:

a bottom wall having a size smaller that that of the supporting surface of the bottom frame;

a surrounding wall upwardly extended from a circumferential edge of the bottom wall to define a supporting cavity within the surrounding wall and the bottom wall, wherein the supporting cavity has a depth smaller than a depth of the playpen cavity, a side holder, which is provided around an upper portion of the surrounding wall, sidewardly extending to hook on the top frame of the playpen so as to support the detachable cot in an upper portion of the playpen cavity and evenly distribute the weight of the detachable cot on the top frame, and a fastening device comprising a plurality of first fastener units spacedly connected to the side holder and a plurality of second fastener units spacedly affixed on an upper portion of the boundary shelter for detachably fastening with the first fastener units respectively so as to securely mount the detachable cot on the collapsible playpen.

DETAILED DESCRIPTION OF THE PREFERRED EMBODIMENT

Figure 1:
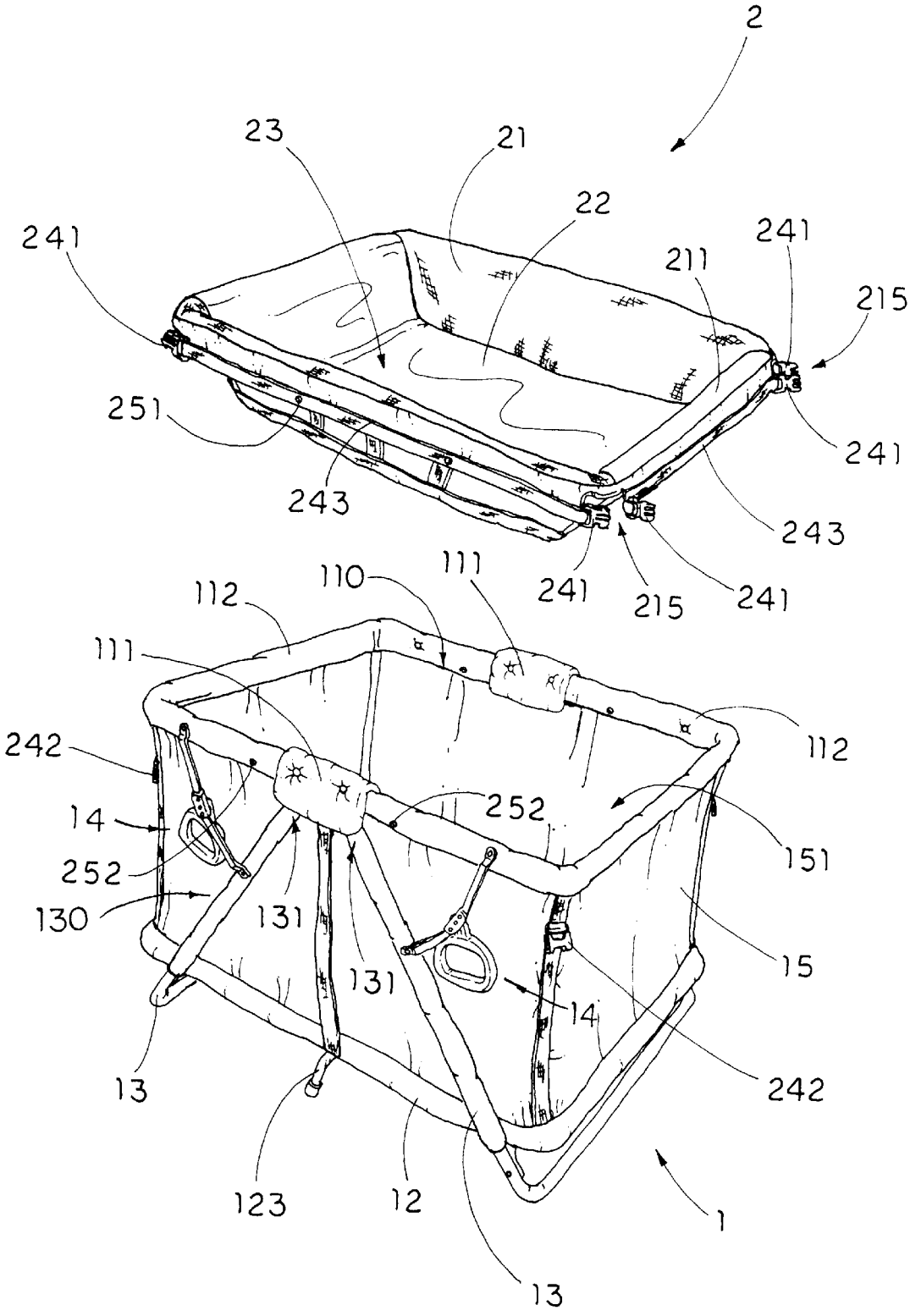
FIG. 1 is an exploded perspective view of a collapsible playpen with a detachable cot according to a preferred embodiment of the present invention.

Referring to FIG. 1 of the drawings, a collapsible playpen 1 with a detachable cot 2 according to a preferred embodiment of the present invention is illustrated, wherein the collapsible playpen 1 comprises a top frame 11, a bottom frame 12, a boundary frame 130 supporting the top frame 11 on top of the bottom frame 12 and defining an interior space between the top frame 11 and the bottom frame 12, and a fabric made boundary shelter 15 supported by the top frame 11 to surround the interior space so as to define a playpen cavity 151 within the boundary shelter 15.

The detachable cot 2 comprises a surrounding wall 21 and a bottom wall 22 to define a supporting cavity 23 having a depth lesser than a depth of the playpen cavity 151, wherein the surrounding wall 21 has an upper side holder 211 for fittedly mounting on the top frame 11 of the playpen 1, and a fastening device 24 comprising a plurality of first fastener units 241 provided on the side holder 211 of the surrounding wall 21 and a plurality of second fastener units 242 provided on the boundary shelter 15 for detachably fastening with the first fastener units 241 respectively, so as to securely mount the detachable cot 2 on the collapsible playpen 1.

Figure 2:
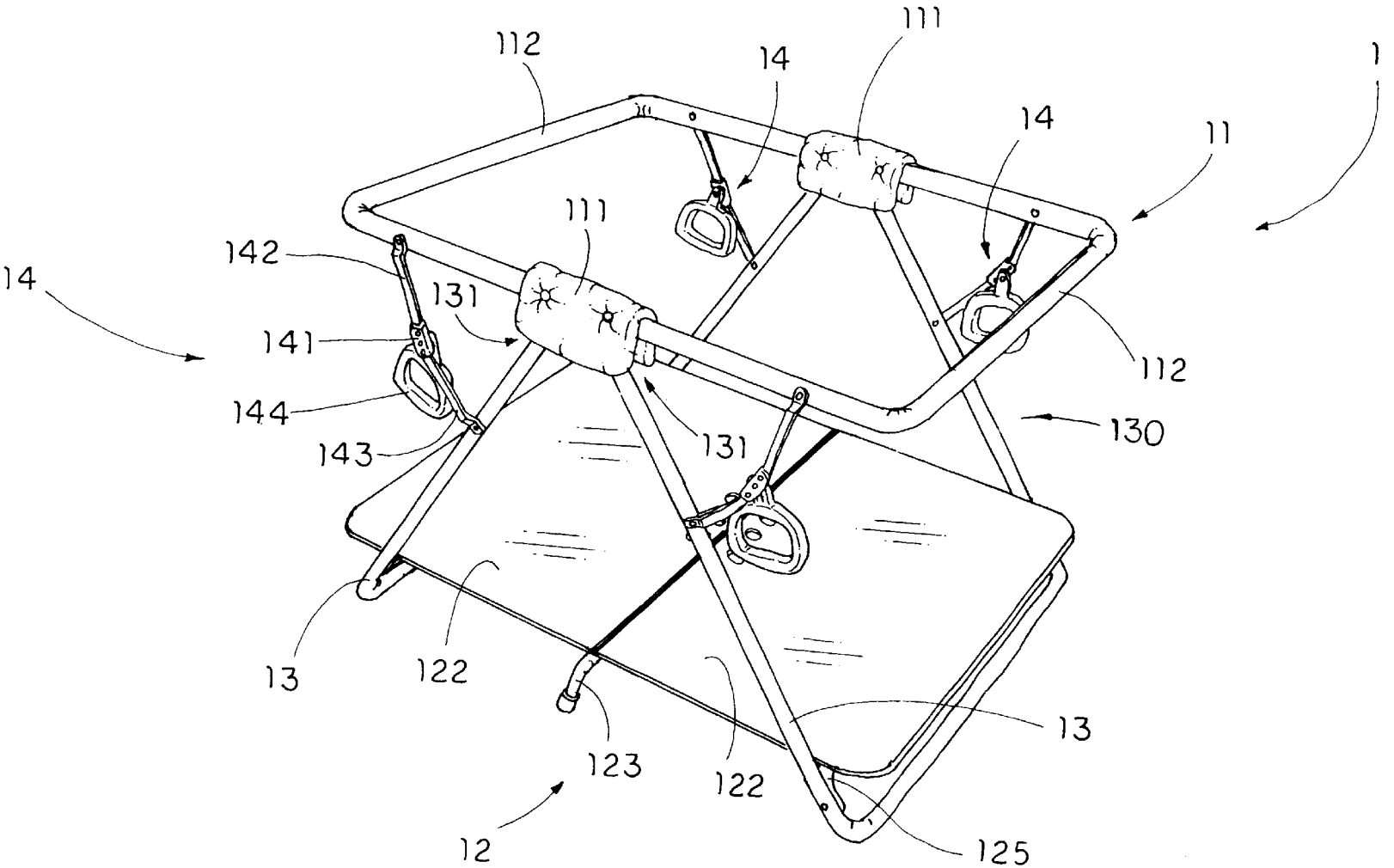
FIG. 2 is a perspective view of the collapsible playpen in a set-up position according to the above preferred embodiment of the present invention.

As shown in FIG. 2, the top frame 11 comprises a pair of top joints 111 and a pair of U-shaped top arms 112 each having two inward ends pivotally connected to the two top joints 111 respectively to form a rectangular top opening 110.

The bottom frame 12 comprises a pair of supporting boards 122 positioned side by side to form a rectangular structure, wherein the bottom frame 12 is disposed below and spaced apart from the top frame 11 in a vertical direction.

The bottom frame 12 further comprises a U-shaped base stand 123, having two downward ground ends, transversely positioned between the two supporting boards 122 and at least two rotatable joints 124 for rotatably mounting the base stand 123 on the supporting boards 122. Accordingly, each of the rotatable joints 124 has a slider body firmly mounted on one of the supporting boards 122 and a sliding through hole transversely formed on the slider body for the base stand 123 sliding therethrough.

The boundary frame 130 comprises two side frames 13 each having a U-shaped has two folding ends 131 pivotally connected to the two top joints 111 respectively wherein the bottom frame 12 is pivotally connected to two lower portions of the two side frames 13 respectively. As shown in FIG. 2, the two side frame 13 are inclinedly and outwardly extended from the top joints 11 to two outer sides of the bottom frame 12 respectively in such a manner that bottom portions of the side frames 13 are arranged to fold outwardly and support on the ground.

In order to rotatably mount the bottom frame 12 on the side frame 13, the bottom frame 12 further comprises a pair of support pillars 125 transversely mounted to the bottom frame 12, and at least two U-shaped tubular holders 126 for rotatably mounting the support pillars 125 on the supporting boards 122 by firmly attaching two ends of each tubular holder 126 on the respective supporting board 122.

Figure 3:
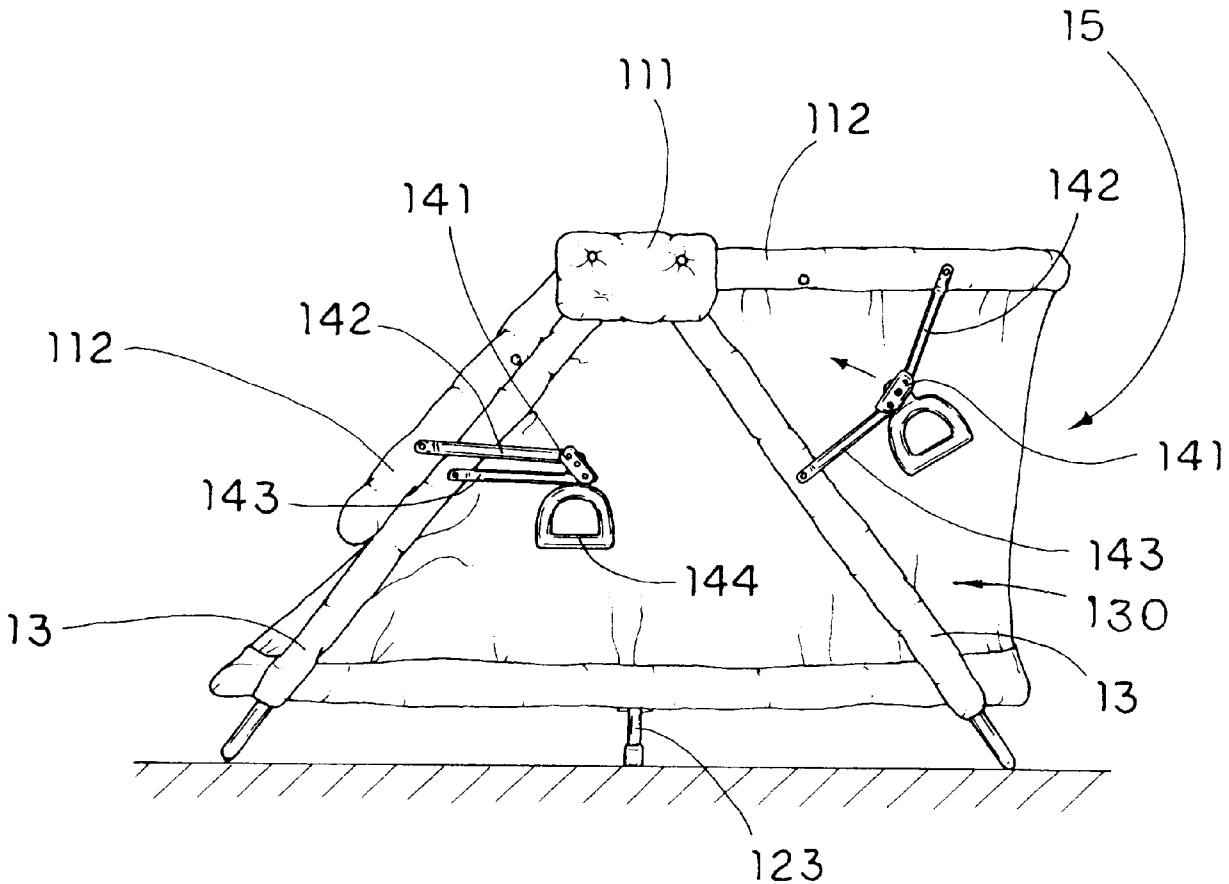
FIG. 3 is a side view of the top frame of the collapsible playpen in a folded position according to the above preferred embodiment of the present invention.

The boundary frame 130 further comprises two pairs of stopper means 14 each pair of which pivotally connecting between the top arm 112 and the side frame 13 for holding the top arm 112 from a folded position to a set-up position, wherein in the set-up position, the two top arms 112 are pivotally lifted up horizontally to form a rectangular structure, as shown in FIG. 2, and in the folded position, the two top arms 112 are pivotally dropped down toward to the two side frames 13 respectively, as shown in FIG. 3.

Accordingly, each of the stopper means 14 comprises a coupling joint 141 having a blocking wall 1411, a first pivot arm 142 having one end pivotally connected to the coupling joint 141 and another end pivotally connected to the top arm 112, and a second pivot arm 143 having one end pivotally connected to the coupling joint 141 and another end pivotally connected to the side frame 13 wherein the coupling joint 141 is arranged to block the pivotal movement of the first and second pivot arms 142, 143 by the blocking wall 1411.

As shown in FIG. 2, the first and second pivot arms 142, 143 are pivotally folded in an outward manner with respect to the coupling joint 141 to bias against the blocking wall 1411 of the coupling joint 141 for limiting the pivotal movement of the two pivot arms 142, 143, so as to support the top arm 112 in the set-up position. When the first and second pivot arms 142, 143 are pivotally folded in an inward manner with respect to the coupling joint 141, the top arm 112 is arranged to drop down toward to the respective side frame 12 so as to fold up the top frame 11, as shown in FIG. 3.

For enhance the folding operation of the top frame 11, the stopper means 14 further comprises an operation handle 144 rotatably mounted on each of the coupling joints 141 wherein the operation handle 144 is arranged to pull the coupling joint 141 to pivotally move the first and second pivot arms 142, 143 between the set-up position and the folded position.

Figure 4:
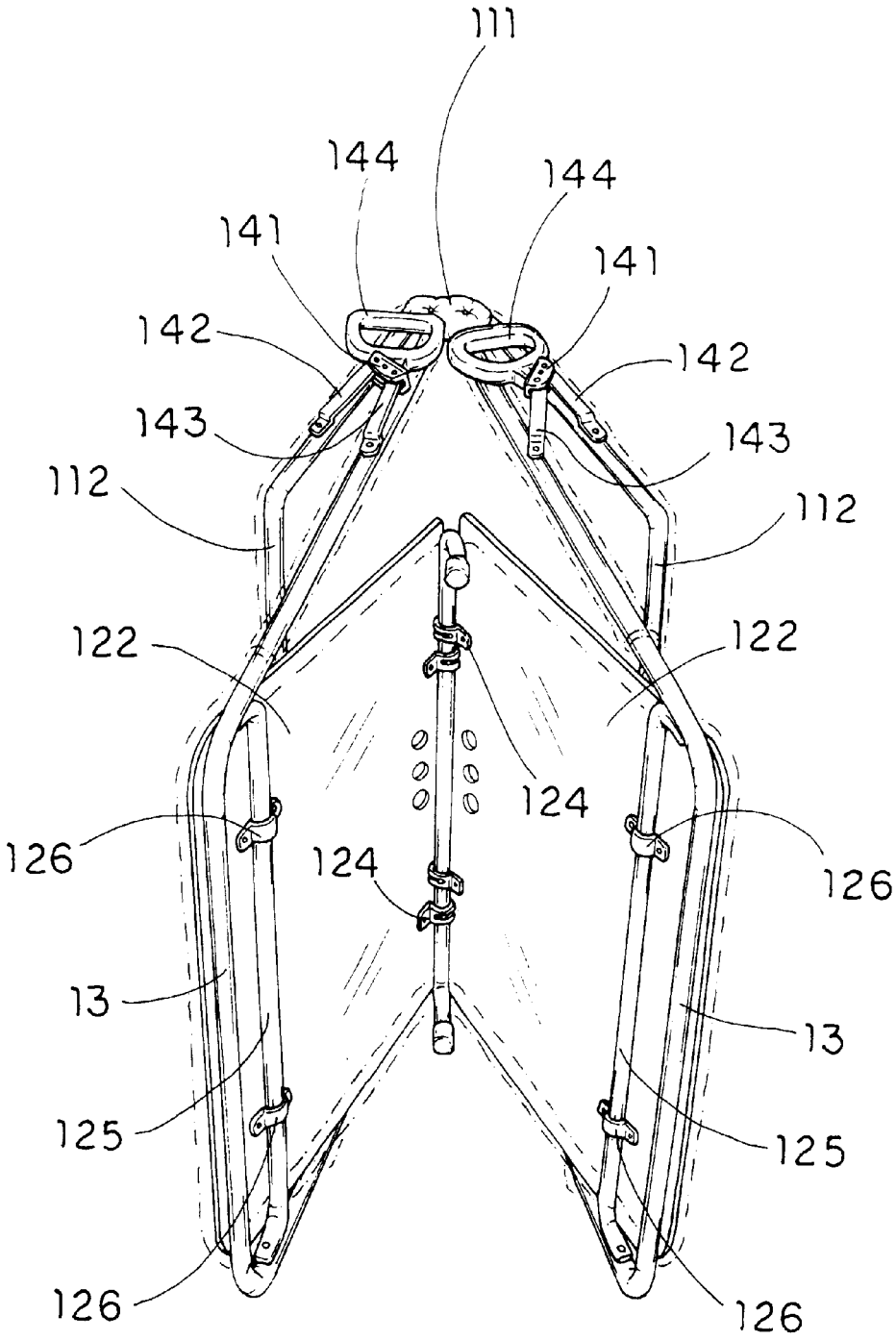
FIG. 4 is a perspective view of the collapsible playpen in a folded position according to the above preferred embodiment of the present invention.

In order to fold up the collapsible playpen 1 as shown in FIG. 4, an upward pulling force must be intentionally applied on the bottom frame 12 at the mid portion thereof so as to pivotally fold the two supporting board 122 towards each other in such a manner that the two side frames 13 are driven to pivotally folded together. Therefore, the collapsible playpen 1 is pivotally folded in a half manner at the mid portion thereof. In other words, the downward force applied by the user's weight on the bottom frame 12 will ensure the collapsible playpen 1 in the set-up position so as to prevent the collapsible playpen 1 from being unfolded accidentally.

Figure 6:
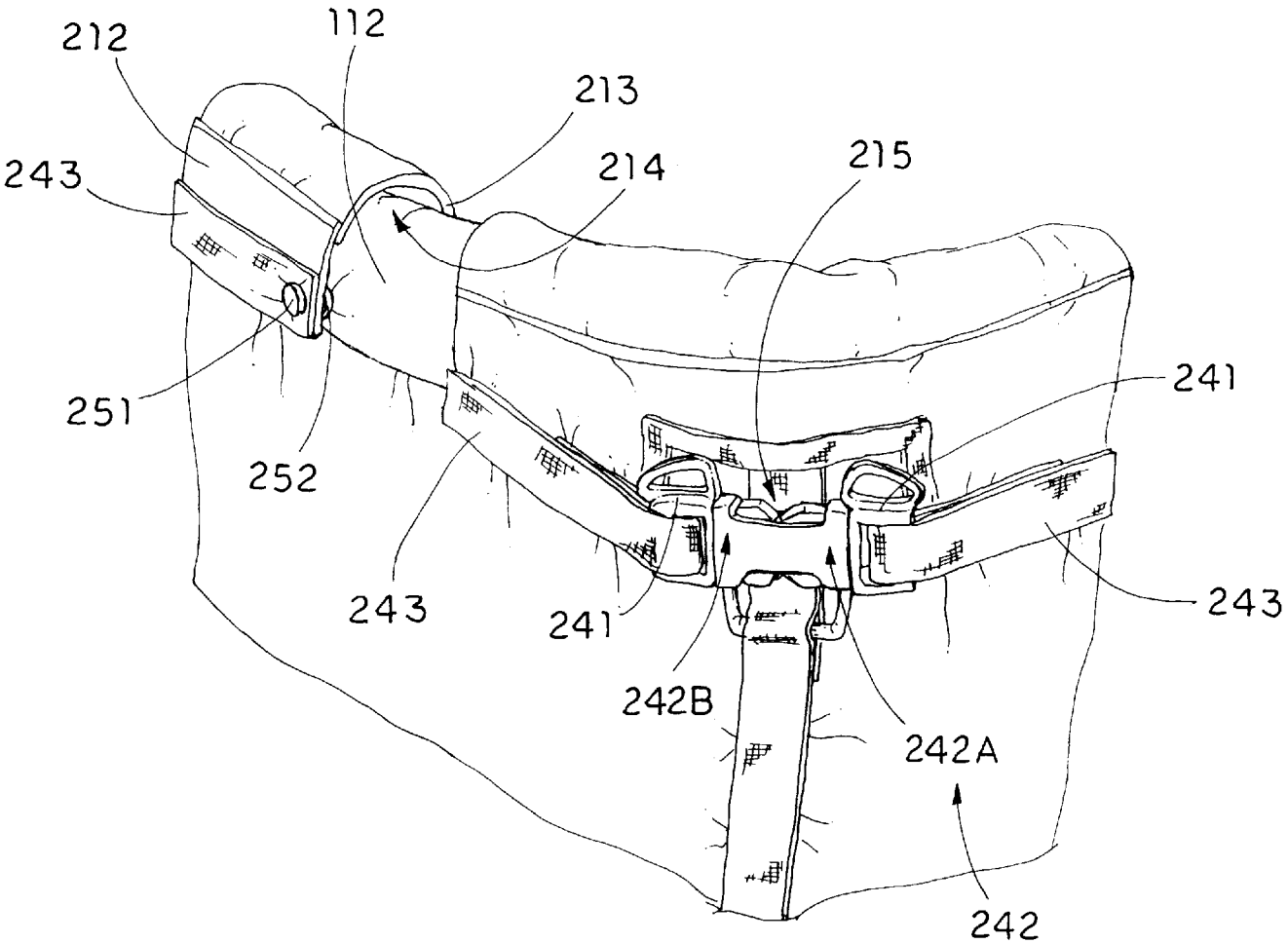
FIG. 6 is a perspective view of a fastening device of the detachable cot according to the above preferred embodiment of the present invention.

As shown in FIG. 6, the side holder 211 of the surrounding wall 21 of the detachable cot 2 is formed by folding a top edge portion outwardly to form an outer wall 212 and an inner wall 213 so as to define a mounting groove 214 having a downward opening for receiving the top arms 112 of the top frame 11. The surrounding wall 21 further has four U-shaped corner opening 215 formed on four corners of the outer wall 212 of the side holder 211.

The first fastener units 241 are provided on the outer wall 212 at the corner openings 215 such that each corner opening 215 of the surrounding wall 21 has two first fastener units 241. The second fastener units 242 are provided on four upper corners of the boundary shelter 14 adjacent to the corner opening 215 of the surrounding wall 21 wherein each of the second fastener units 242 is adapted to detachably fasten to two respective first fastener units 241 at the corner opening 215.

Accordingly, each of the first fastener units 241 is a buckle plug transversely provided on the outer wall 212 at the respective corner opening 215 and each of the second fastener 242 is a buckle socket having two opposed socket inlets 242*a*, 242*b* for detachably fastening with the two first fastener units 31 at the respective corner opening 215 respectively, as shown in FIG. 6.

The fastening device 24 further comprises a plurality of reinforcing straps 243 each transversely mounted on the outer wall 212 and extended from one corner opening 215 to another corner opening 215 wherein each of the reinforcing straps 33 has two free ends for firmly attaching two adjacent first fastener units 241 respectively. Moreover, the reinforcing straps 243 can enhance the tight mounting engagement between the side holder 211 of the surrounding wall 21 and the top frame 11 so as to secure the detachable cot 2 on the playpen 1.

In order to position the detachable cot 2 on the playpen 1, the detachable cot 2 further comprises a first positioning member 251 provided on an inner side of the outer wall 212 of the surrounding wall 21 and a second positioning member

Figure 5:
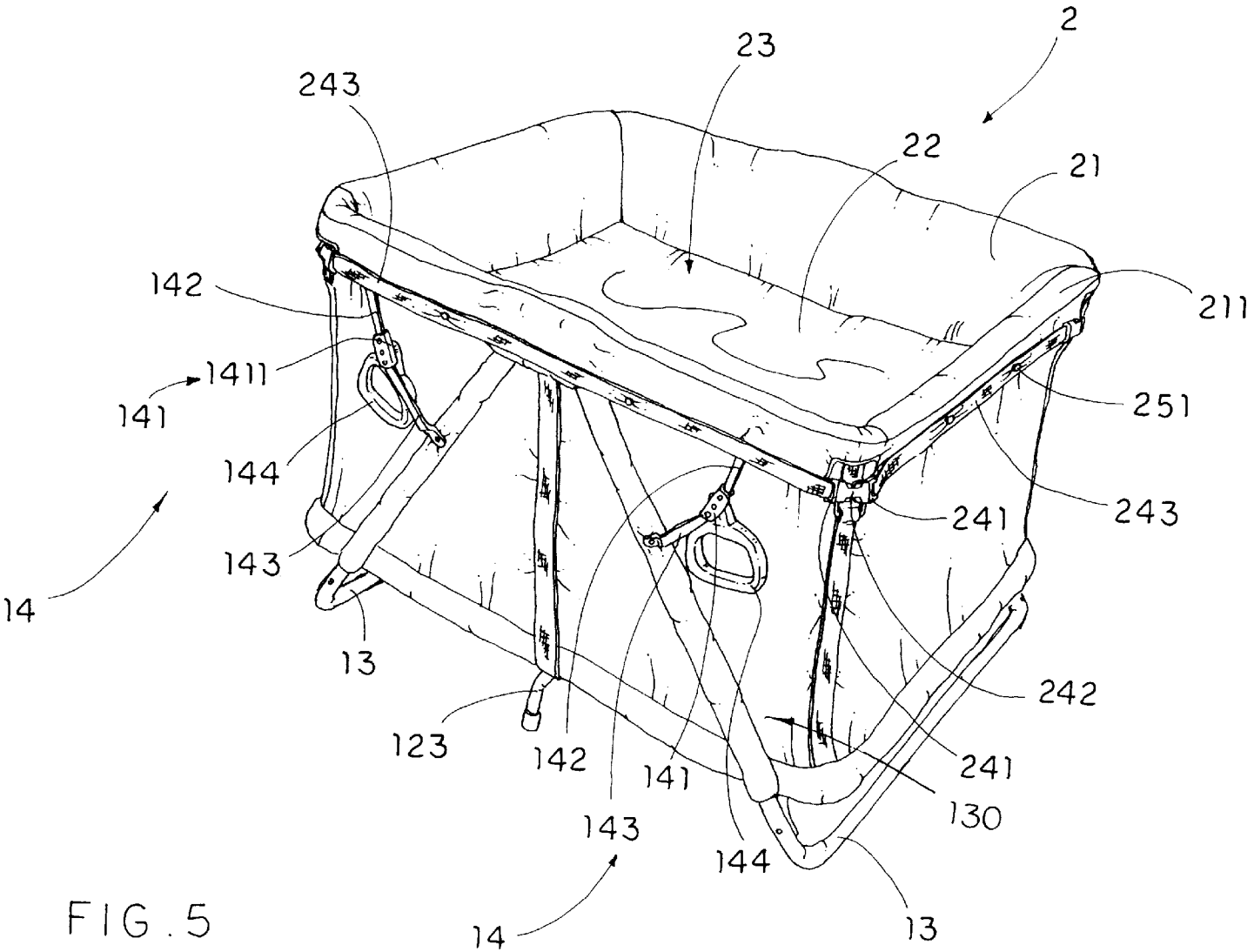
FIG. 5 is a perspective view of the detachable cot mounted on the collapsible playpen according to the above preferred embodiment of the present invention.

252 provided on an outer side of a top edge portion of the boundary shelter 14 wherein the side holder 211 of the surrounding wall 21 is precisely mounted on the top frame 11 by detachably attaching the first positioning member 251 to the second positioning member 252, as shown in FIG. 5.

Accordingly, the first and second positioning members 251, 252 are plurality pairs of first and second snap fasteners spacedly provided on the inner side of the outer wall 212 of the surrounding wall 21 and the outer side of a top edge portion of the boundary shelter 14 respectively such that when the detachable cot 2 is mounted on the playpen, the side holder 211 of the surrounding wall 21 is reinforced to retain on the top frame 11 of the playpen 1.

In view of above, when the detachable cot 2 is mounted on the playpen 1, the playpen 1 can be form a cot for the baby accommodating therein so as to facilitate the parent to pull and take a small child in the detachable cot 2. When the detachable cot 2 is disposed in the playpen cavity 151 of the playpen 1, the parent is able to pull the baby in the playpen 1 for the baby playing therein, so as to restrict the movement of the baby.

What is claimed is:

1. A playpen, comprising:

a top frame having four corners and defining a top opening therebetween wherein said top frame comprises a pair of top joints and a pair of U-shaped top arms each having two inward ends pivotally connected to said two top joints respectively to form a rectangular top opening;

a bottom frame having a supporting surface, wherein said bottom frame comprises a pair of supporting boards positioned side by side to form a rectangular structure wherein said bottom frame is disposed below and spaced apart from said top frame in a vertical direction;

a boundary frame which supports said top frame on top of said bottom frame and defining an interior space between said top frame and said bottom frame, wherein said boundary frame comprises two U-shaped side frames and two pairs of stopper means, wherein each of said side frames has two folding ends pivotally connected to said two top joints respectively and outwardly and inclinedly folded to connect said bottom frame at two lower portions thereof, wherein each of said stopper means is pivotally connected between said top arm and said side frame for holding said top arm from a folded position to an unfolded set-up position;

a boundary shelter supported by said top frame to surround said interior space and define a playpen cavity within said boundary shelter, said top frame and said bottom frame; and a detachable cot comprising:

a bottom wall having a size smaller that that of said supporting surface of said bottom frame;

a surrounding wall upwardly extended from circumferential edge of said bottom wall to define a supporting cavity within said surrounding wall and said bottom wall, wherein said supporting cavity has a depth smaller than a depth of said playpen cavity;

a side holder, which is provided around an upper portion of said surrounding wall, sidewardly extending to hook on said top frame of said playpen so as to support said detachable cot in an upper portion of said playpen cavity and evenly distribute the weight of the detachable cot on said top frame, and a fastening device comprising a plurality of first fastener units spacedly connected to said side holder and a plurality of second fastener units spacedly affixed on an upper portion of said boundary shelter for detachably fastening with said first fastener units respectively so as to securely mount said detachable cot on said collapsible playpen;

wherein in said unfolded set-up position, said two top arms are pivotally lifted up horizontally to form a rectangular structure, and in said folded position, said two top arms are pivotally dropped down toward to said two side frames respectively, wherein said side holder of said surrounding wall of said detachable cot is formed by folding a top edge portion outwardly to form an outer wall and an inner wall so as to define a mounting groove having a downward opening for receiving said top arms of said top frame, wherein said surrounding wall further has four U-shaped corner opening formed on four corners of said outer wall of said side holder of said surrounding wall.

2. The collapsible playpen, as recited in claim 1, wherein said first fastener units are provided on said outer wall at said corner openings such that each said corner opening of said surrounding wall has two said first fastener units, and wherein said second fastener units are provided on four upper corners of said boundary shelter adjacent to said corner opening of said surrounding wall wherein each of said second fastener units is adapted to detachably fasten to two respective first fastener units at said corner opening.

3. The collapsible playpen, as recited in claim 2, wherein said fastening device further comprises a plurality of reinforcing straps each of which is transversely mounted on said outer wall and extended from one of said corner openings to another said corner opening, wherein each of said reinforcing straps has two free ends for firmly and respectively attaching said two buckle plugs of two said first fastener units, so as to enhance a tight mounting engagement between said side holder of said surrounding wall and said top frame.

4. The collapsible playpen, as recited in claim 2, wherein each of said first fastener units comprises a pair of buckle plugs transversely provided on said outer wall at two ends of said respective corner opening and each of said second fastener unit comprises a buckle socket having two opposed socket inlets for detachably fastening with said two buckle plugs at said respective corner opening respectively.

5. The collapsible playpen, as recited in claim 4, wherein said fastening device further comprises a plurality of reinforcing straps each of which is transversely mounted on said outer wall and extended from one of said corner openings to another said corner opening, wherein each of said reinforcing straps has two free ends for firmly and respectively attaching said two buckle plugs of two said first fastener units, so as to enhance a tight mounting engagement between said side holder of said surrounding wall and said top frame.

6. The collapsible playpen, as recited in claim 5, wherein said detachable cot further comprises a first positioning member provided on an inner side of said outer wall of said surrounding wall and a second positioning member provided on an outer side of a top edge portion of said boundary shelter wherein said side holder of said surrounding wall is precisely mounted on said top frame by detachably attaching said first positioning member to said second positioning member.

7. The collapsible playpen, as recited in claim 6, wherein said first and second positioning members are plurality pairs of first and second snap fasteners spacedly provided on said inner side of said outer wall of said surrounding wall and said outer side of said top edge portion of said boundary shelter respectively such that when said detachable cot is mounted on said playpen, said side holder of said surrounding wall is reinforced to retain on said top frame of said playpen.

* * * * *